US009816473B2

(12) United States Patent
Kraft et al.

(10) Patent No.: US 9,816,473 B2
(45) Date of Patent: Nov. 14, 2017

(54) INJECTION SYSTEM

(71) Applicants: Thomas Kraft, Obertraubling (DE); Tobias Ritsch, Dieterskirchen (DE); Christoph Klesse, Worth a. d. Danau (DE)

(72) Inventors: Thomas Kraft, Obertraubling (DE); Tobias Ritsch, Dieterskirchen (DE); Christoph Klesse, Worth a. d. Danau (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 292 days.

(21) Appl. No.: 14/360,943

(22) PCT Filed: Dec. 13, 2012

(86) PCT No.: PCT/EP2012/075362
§ 371 (c)(1),
(2) Date: May 28, 2014

(87) PCT Pub. No.: WO2013/092367
PCT Pub. Date: Jun. 27, 2013

(65) Prior Publication Data

US 2016/0290298 A1 Oct. 6, 2016

(30) Foreign Application Priority Data

Dec. 21, 2011 (DE) ..... 10 2011 089 478

(51) Int. Cl.
*F02M 59/46* (2006.01)
*F02D 41/38* (2006.01)

(52) U.S. Cl.
CPC ..... *F02M 59/466* (2013.01); *F02D 41/3845* (2013.01); *F02M 59/462* (2013.01)

(58) Field of Classification Search
CPC .... F02M 59/462; F02M 59/466; F02M 59/46; F02D 41/3845
(Continued)

(56) References Cited

U.S. PATENT DOCUMENTS 5,125,807 A 6/1992 Kohler et al. ..... 417/490
5,143,345 A * 9/1992 Miki ..... F16K 31/0665 251/129.02
(Continued)

FOREIGN PATENT DOCUMENTS

CN 1993546 A 7/2007 ..... F02M 59/46
DE 19752013 A1 5/1998 ..... F02M 51/00
(Continued)

OTHER PUBLICATIONS

Chinese Office Action, Application No. 201280063401.0, 14 pages, Oct. 10, 2015.
(Continued)

*Primary Examiner* — Mahmoud Gimie
(74) *Attorney, Agent, or Firm* — Slayden Grubert Beard PLLC

(57) ABSTRACT

An injection system for an internal combustion engine may include a high-pressure pump for delivering fuel at high pressure into a high-pressure region, wherein the high-pressure pump includes an inlet valve and an electrically switched, digitally actuated outlet valve. The outlet valve is designed as a normally-open outlet valve. In this way, it is possible to dispense with a pressure relief valve for the high-pressure region.

14 Claims, 6 Drawing Sheets

(58) Field of Classification Search
USPC ..... 123/458, 506, 456; 417/540
See application file for complete search history.

(56) References Cited

U.S. PATENT DOCUMENTS

| | | | | | |
|---|---|---|---|---|---|
| 5,160,116 | A * | 11/1992 | Sugiura | F16K 31/0665 | 137/596.17 |
| 5,642,716 | A * | 7/1997 | Ricco | F02D 41/3809 | 123/447 |
| 5,911,208 | A | 6/1999 | Furusawa et al. | | 123/506 |
| 7,389,767 | B2 | 6/2008 | Käsbauer et al. | | 123/457 |
| 7,438,057 | B2 | 10/2008 | Scheurer et al. | | 123/514 |
| 8,667,986 | B2 | 3/2014 | Roth | | 137/495 |

FOREIGN PATENT DOCUMENTS

| | | | | |
|---|---|---|---|---|
| DE | 19963926 | A1 | 7/2001 | F02M 45/04 |
| DE | 10329331 | B3 | 5/2005 | F02D 41/12 |
| DE | 102010042350 | A1 | 5/2012 | F02D 1/00 |
| EP | 0391366 | A2 | 10/1990 | F02M 55/00 |
| EP | 2333303 | A2 | 6/2011 | F02M 59/46 |
| JP | 2007046501 | A | 2/2007 | F02M 47/00 |
| WO | 2013/092367 | A1 | 6/2013 | F02M 59/46 |

OTHER PUBLICATIONS

International Search Report and Written Opinion, Application No. PCT/EP2012/075362, 8 pages, Apr 9, 2014.
Chinese Office Action, Application No. 201280063401.0, 11 pages, Jun. 6, 2016.

* cited by examiner

INJECTION SYSTEM

CROSS-REFERENCE TO RELATED APPLICATIONS

This application is a U.S. National Stage Application of International Application No. PCT/EP2012/075362 filed Dec. 13, 2012, which designates the United States of America, and claims priority to DE Application No. 10 2011 089 478.0 filed Dec. 21, 2011, the contents of which are hereby incorporated by reference in their entirety.

TECHNICAL FIELD

The present invention relates to an injection system for an internal combustion engine having a high-pressure pump for delivering fuel under high pressure to a high-pressure region which feeds a plurality of injectors, the high-pressure pump including an inlet valve and an electrically switched, digitally activated outlet valve, which outlet valve comprises a valve seat, a closing body cooperating with the valve seat, an electromagnetically actuated actuator for the closing body and a spring cooperating with the closing body.

BACKGROUND

The German patent application 10 2010 042 350.5 proposes a high-pressure control device for an injection system which has the aforedescribed features. In this case the control is effected by digitally switching the inlet and outlet valves with one actuator or two actuators. Such a pump with digitally switched inlet and outlet valves has various advantages. However, even in this embodiment an additional mechanical pressure relief valve (PRV) arranged in the high-pressure path downstream of the outlet valve is necessary, since in the event of the fault "Maximum delivery of pump", for example as a result of a defective outlet valve, there must be a possibility of reducing the pressure on the high-pressure side, so that the system does not "burst" as a result of the pressure increases occurring in this case.

Such a mechanical pressure relief valve of this type is arranged, for example, in the high-pressure pump in parallel to the pump outlet valve and, depending on the concept selected, either effects a relief of pressure in the cylinder chamber (hydraulically locked in this case, since it is closed in the pumping phase of the pump) or shuts off gradually on the low-pressure side upstream of the pump inlet valve. This pressure relief valve is activated, for example, in the following situations: because of a mechanical or electrical fault the electrically switched outlet valve can no longer be activated. The high-pressure pump no longer delivers fuel to the high-pressure region. The outlet valve is forced shut because of the pressure present on the high-pressure side (in the rail). If the vehicle is in coasting mode (no injection) or is switched off, the pressure of the volume enclosed on the high-pressure side downstream of the pump outlet valve (high-pressure petrol injection valves have no leakage) will rise in dependence on the fuel temperature. If the vehicle is switched off, for example at a system pressure of 50 bar, and if, for example, the fuel temperature rises from 20° C. to 40° C. in the high-pressure region (inside the rail) after the engine has been switched off (because of the engine waste heat with the vehicle stationary), the system pressure rises, for example, from 50 bar to 250 bar. If no pressure reduction possibility were then present on the high-pressure side, this would necessarily lead to bursting of the system with such temperature increases, or would prevent a limp-home mode since the injectors no longer open above a given maximum pressure.

With the above-described injection system in which a normally-closed (that is, "currentlessly-closed") outlet valve is used, a mechanical pressure relief valve therefore continues to be necessary.

SUMMARY

One embodiment provides an injection system for an internal combustion engine having a high-pressure pump for delivering fuel under high pressure to a high-pressure region which feeds a plurality of injectors, the high-pressure pump including an inlet valve and an electrically switched, digitally activated outlet valve, the outlet valve comprising a valve seat, a closing body cooperating with the valve seat, an electromagnetically actuated actuator for the closing body and a spring cooperating with the closing body, wherein the outlet valve is in the form of a normally-open outlet valve.

In a further embodiment, the spring holds the closing body in an open position when the actuator is inactive and hydraulic pressure compensation is present.

In a further embodiment, upon activation and with hydraulic pressure compensation present, the actuator moves the closing body to the closed position against the force of the spring.

In a further embodiment, the outlet valve includes an actuator rod connected to the closing body and to an armature, and in that the spring is supported between the armature and a housing section of the outlet valve.

In a further embodiment, the outlet valve has a housing at one end of which the valve seat is arranged and at the other end a connection for the high-pressure region, and in that the actuator rod extends through the housing section 813) provided with at least one through-flow opening.

In a further embodiment, the closing body is spherical and cooperates with a conical valve seat.

In a further embodiment, the injection system does not have a pressure relief valve for the high-pressure region.

BRIEF DESCRIPTION OF THE DRAWINGS

Example embodiment of the invention are explained in detail below with reference to the drawings, in which.

DETAILED DESCRIPTION

Figure 1:
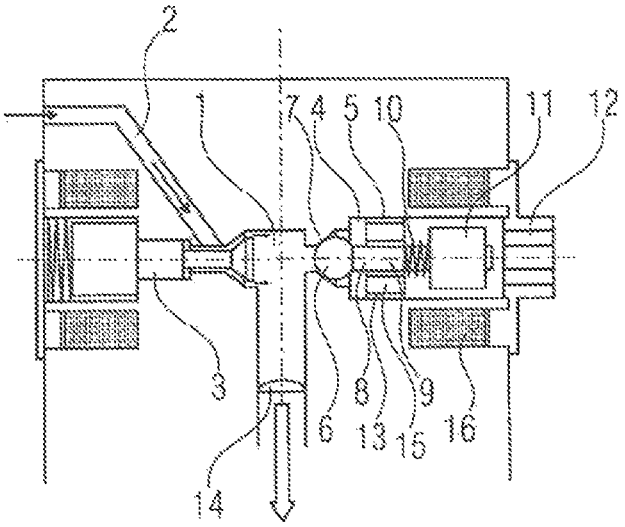
FIG. 1 is a schematic representation of a high-pressure pump with inlet valve and outlet valve in the suction phase of the pressure increase mode.

Embodiments of the present invention provide an injection system of the type described in the introduction which is distinguished by an especially simple, cost-saving design.

In some embodiments, an outlet valve of the injection system is a normally-open outlet valve.

In some embodiments of the injection system, a normally-open outlet valve is used instead of a normally-closed outlet valve. In this case, however, in order to close the outlet valve only a short pulse of current is needed, so that the closing process can be triggered. After that, corresponding hydraulic forces are again effective.

Because, the outlet valve is open without current, that is, in the inactive state of the actuator, there is no danger of the outlet valve closing in the event of damage (mechanical fault, electrical fault). In the case of damage the outlet valve definitely does not close automatically following the delivery phase, for example, as a result of the closing body being entrained by the back-flowing fuel, thereby closing the valve. Rather, the valve remains in the open state.

This is implemented constructionally, for example, in that the spring cooperating with the closing body holds the closing body in an open position with the actuator inactive and the hydraulic pressure compensated. During the delivery phase to the high-pressure region, as soon as the pressure in the compression chamber of the high-pressure pump is greater than the pressure in the high-pressure region (rail), the outlet valve is opened by the pressure difference and the fuel is delivered to the high-pressure region. At this time the outlet valve is pressure-equalized. In order to close it only the spring force needs to be overcome. This is achieved by activating the actuator. A deactivation then follows.

When activation and hydraulic pressure compensation are present, the actuator moves the closing body against the force of the spring to the closed position. In the case of a fault of the actuator, the outlet valve is not closed, so that in this case an overpressure cannot build up in the high-pressure region. Rather, the pressure is gradually reduced via the open outlet valve. The fuel which then continues to be introduced under low pressure into the high-pressure region by the high-pressure pump does not cause "bursting" of the system.

Regarding the constructional configuration of the outlet valve, it preferably has an actuator rod connected to the closing body and to an armature, and the spring is supported between the armature and a housing section of the outlet valve. In this case the outlet valve specifically has a housing at one end of which the valve seat is arranged and at the other a connection for the high-pressure region, the actuator rod extending through the housing section, which is provided with at least one through-flow opening. The housing may be, for example cylindrical while the housing section may be a disk which is inserted in the cylindrical housing and has at least one through-flow opening, and through which the actuator rod extends displaceably. With the hydraulic pressure compensated and the actuator inactive, the spring provided, which is supported between the armature and the housing section (disk), pulls the closing body away from the valve seat so that the valve is opened. If the actuator is activated, the armature moves the closing body against the spring force to its closed position via the actuator rod, to which the closing body is connected.

The closing body may be spherical and may cooperates with a conical valve seat.

As mentioned, the disclosed injection system does not require a pressure relief valve for the high-pressure region, since the actuator closes the valve and, in the event of a defective actuator, the outlet valve is not closed (because of the spring provided). Rather, the valve is always open with the actuator inactive and the hydraulic pressure compensated.

FIG. 1 shows schematically a fuel supply line 2 coming from the low-pressure side which opens via an electrically switched, digitally activated inlet valve 3 into the compression chamber 1 of a high-pressure pump. A piston 14, which in the suction phase shown here in FIG. 1 is moved downwards, is located in the compression chamber 1. The compression chamber 1 is connected to an outlet valve 4 comprising a cylindrical housing 5 which has at one end a valve seat 7 and at the other end a connection 12 to a high-pressure region (rail). A spherical closing body 6 cooperating with the valve seat 7 is located in the cylindrical housing 5 and is connected to an actuator rod 9 having an armature 11 which is mounted inside a coil 16 arranged outside the housing. A disk-shaped housing section 13 having a plurality of through-openings 15 and a central bore through which the actuator rod 9 passes is also located in the housing 5.

A spring 10 which is supported between the housing section 13 and the armature 11 is dimensioned such that it holds the outlet valve 4 open in the pressure compensated state.

In the suction phase represented in FIG. 1 the inlet valve 3 and the outlet valve 4 are electrically inactive. Because the inlet valve 3 is normally open the compression chamber 1 is filled with fuel by the downward movement of the piston 14. The outlet valve 4 is held shut by the system pressure present in the high-pressure region (rail). The actuator of the outlet valve is inactive.

Figure 2:
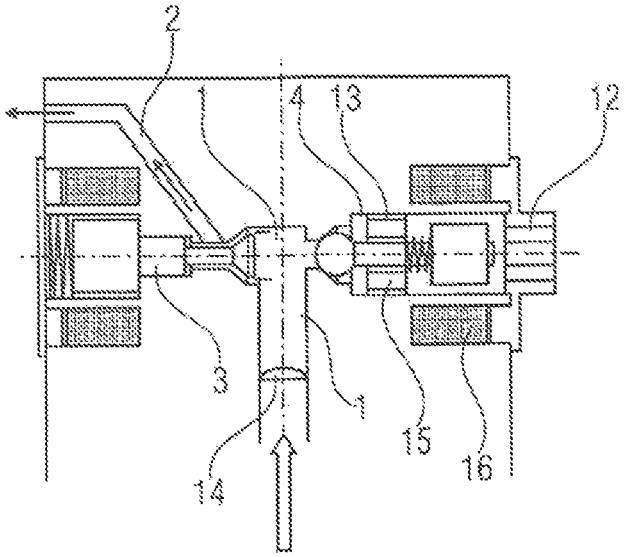
FIG. 2 is a representation corresponding to that of FIG. 1 in the return flow phase of the pressure increase mode.

FIG. 2 shows the return delivery phase into the supply line 2 in the pressure increase mode. The inlet and outlet valves 3, 4 are again electrically inactive. The fuel in the compression chamber is pumped back into the supply line until the inlet valve 3 receives the signal to close.

Figure 3:
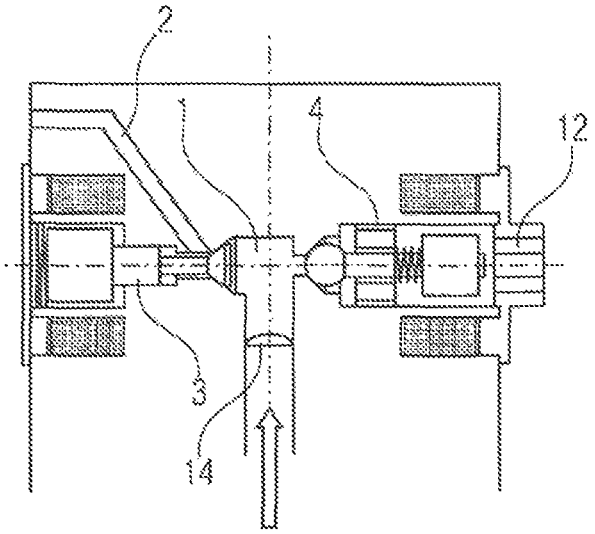
FIG. 3 is a representation corresponding to that of FIG. 1 in the pressure increase phase of the pressure increase mode.

In the pressure increase phase of the pressure increase mode shown in FIG. 3, the inlet valve 3 is briefly activated electrically in order to trigger a closing impulse. The outlet valve 4 remains electrically inactive. As soon as the pressure in the compression chamber rises as compression begins, the inlet valve 3 is held shut hydraulically.

Figure 4:
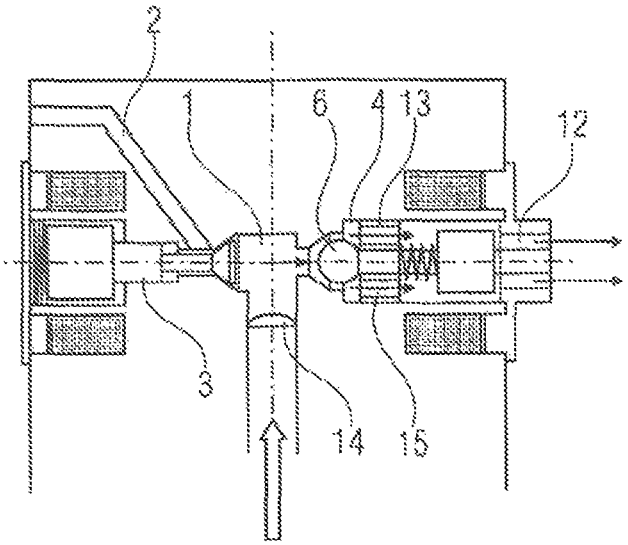
FIG. 4 is a representation corresponding to that of FIG. 1 in the delivery phase of the pressure increase mode.

FIG. 4 shows the delivery phase into the high-pressure region in the pressure increase mode. The inlet and outlet valves 3, 4 are electrically inactive. The inlet valve 3 is locked hydraulically by the higher pressure in the compression chamber 1. As soon as the pressure in the compression chamber 1 is greater than the pressure in the high-pressure region (rail), the outlet valve 4 is opened by the pressure difference and fuel is delivered into the high-pressure region. FIG. 4 shows the outlet valve 4 with the closing body 6 open. The arrows represent the fuel flowing to the high-pressure region through the through-flow openings 15 of the housing section 13.

Figure 5:
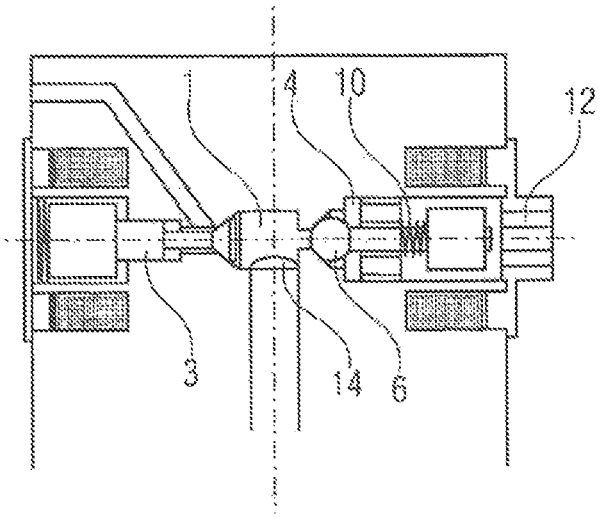
FIG. 5 is a representation corresponding to that of FIG. 1 at the start of the suction phase of the pressure increase mode.

FIG. 5 shows the start of the suction phase. At this time the outlet valve 4 is pressure-compensated. It is therefore held open by the force of the spring 10. In order to close the valve for the start of the suction phase the actuator is activated so that the closing body 6 is moved against the valve seat 7. This happens against the force of the spring 10. The outlet valve 4 is then deactivated electrically again. However, it remains closed since the system pressure in the high-pressure region (rail) presses the valve shut.

Figure 6:
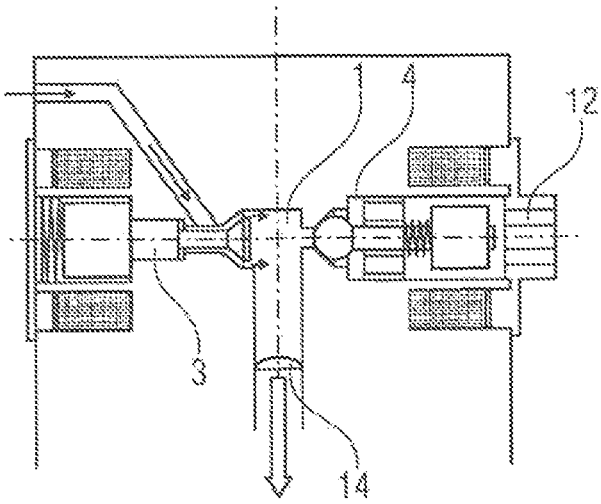
FIG. 6 is a representation corresponding to that of FIG. 1 in the suction phase of the pressure increase mode.

FIG. 6 shows the pump suction phase in the pressure increase mode. The inlet and outlet valves 3, 4 are electrically inactive. Because the inlet valve 3 is normally open, the compression chamber 1 is filled. The outlet valve 4 is held shut by the system pressure present in the high-pressure region.

Figure 7:
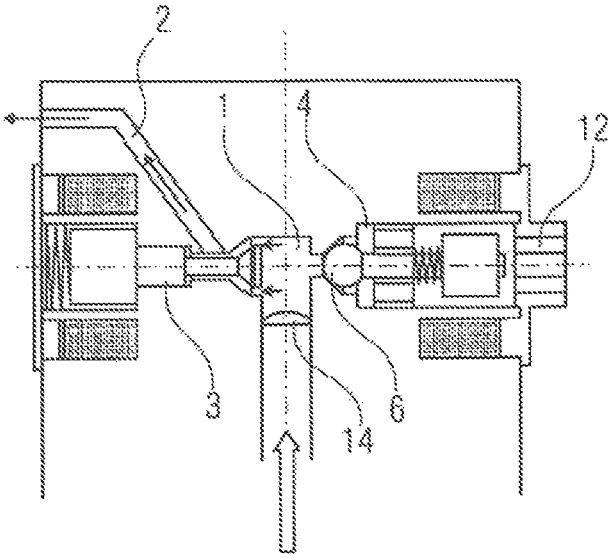
FIG. 7 is a representation corresponding to that of FIG. 1 in the return flow phase of the pressure reduction mode.

FIG. 7 shows the return delivery phase of the pump in the pressure reduction mode. The inlet and outlet valves 3, 4 are electrically inactive. In order to be able to open the outlet valve 4 in the next step, volume is apportioned in the compression chamber 1 in order to achieve a pressure equalization and in order then to open the outlet valve 4 only against the force of the spring 10.

Figure 8:
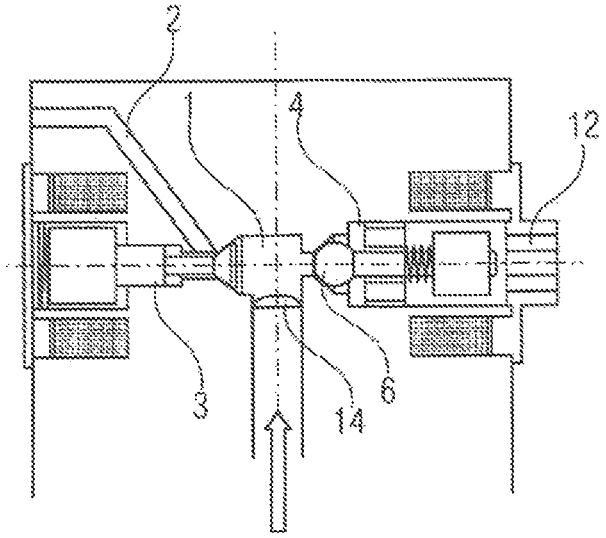
FIG. 8 is a representation corresponding to that of FIG. 1 in the pressure compensation phase of the pressure reduction mode.

FIG. 8 shows the equal-pressure phase in the pressure reduction mode. The inlet valve 3 is briefly activated electrically in order to close it. The pressure increase then takes place until pressure is equalized between compression chamber 1 and the pressure in the high-pressure region (rail). The pressure in the high-pressure region holds the outlet valve 4 closed.

Figure 9:
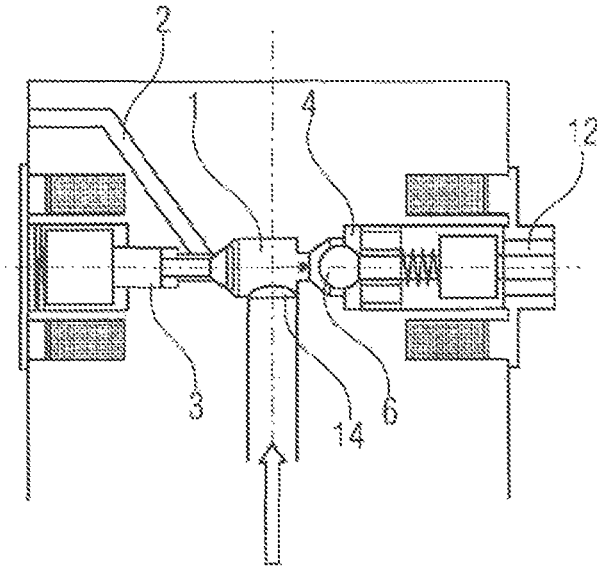
FIG. 9 is a representation corresponding to that of FIG. 1 in the pressure compensation position of the pressure reduction mode.

In the representation of FIG. 9 the pressure equalization between the compression chamber 1 and the system pressure (high-pressure region) is reached. The outlet valve 4 is now opened only by the force of the spring 10.

Figure 10:
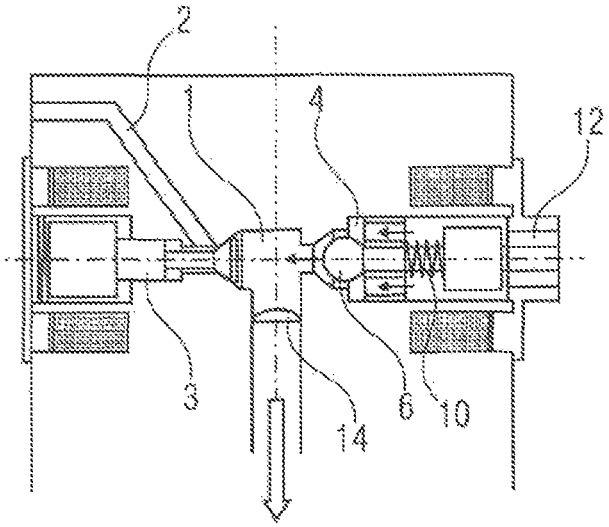
FIG. 10 is a representation corresponding to that of FIG. 1 in the pressure reduction phase of the pressure reduction mode.

FIG. 10 shows the proportioning of the volume to be discharged in the pressure reduction mode. Through the opening of the outlet valve 4 by the force of the spring 10, the pressure in the compression chamber 1 is reduced by the same amount as in the high-pressure region. If equal pressure conditions are present on both sides of the outlet valve 4, throughout this time the outlet valve 4 is held open only by the force of the spring 10. When the piston 14 moves downwards in the compression chamber 1, the pressure in the compression chamber and in the high-pressure region is reduced by the same value. The outlet valve 4 therefore remains pressure-compensated and is held open by the spring force.

Figure 11:
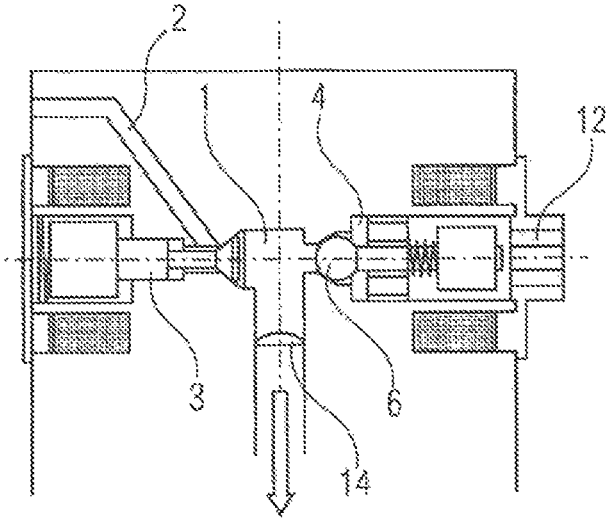
FIG. 11 is a representation corresponding to that of FIG. 1 in the pressure reduction phase of the pressure reduction mode.

FIG. 11 shows the ending of the pressure reduction in the pressure reduction mode. Once the required pressure reduction is reached, the outlet valve 4 is closed again by brief electrical activation of the actuator thereof. The high-pressure reduction is thereby ended.

Figure 12:
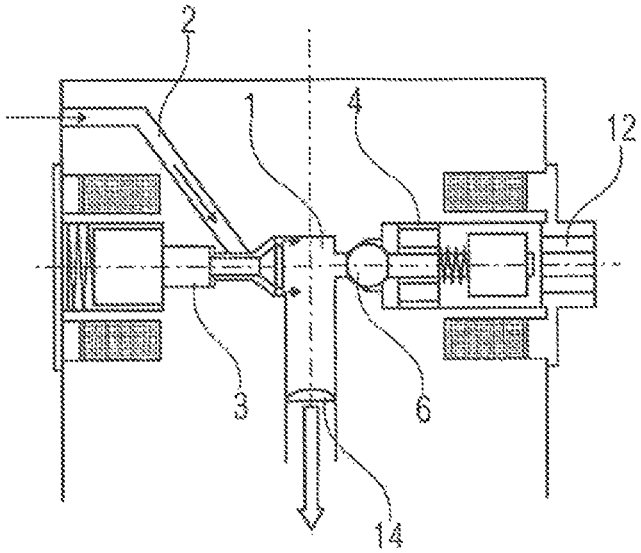
FIG. 12 is a representation corresponding to that of FIG. 1 in the suction phase of the pressure reduction mode.

FIG. 12 shows the suction phase of the pump in the pressure reduction mode. The inlet and outlet valves 3, 4 are electrically inactive. With the further downward movement of the piston 14 fuel flows into the compression chamber 1.

As the outlet valve 4 is in the form of a normally-open outlet valve, the outlet valve does not automatically close, even in the case of a mechanical or electrical defect thereof, since that is prevented by the spring provided. In this way the build-up of overpressure in the high-pressure region is avoided without the need to provide a separate pressure relief valve for the high-pressure region.

What is claimed is:

1. An injection system for an internal combustion engine, comprising:

a high-pressure pump with a compression chamber, the pump operable to deliver fuel under high pressure to a high-pressure region of the internal combustion engine that feeds a plurality of injectors, an inlet valve, and an electrically switched, digitally activated outlet valve comprising:

a valve seat, a closing body cooperating with the valve seat, an electromagnetically actuated actuator for the closing body, and a spring cooperating with the closing body, wherein the outlet valve is a normally-open outlet valve, and wherein fuel flows from the compression chamber to the high-pressure region if the actuator is inactive and a fuel pressure in the compression chamber is higher than a fuel pressure in the high-pressure region.

2. The injection system of claim 1, wherein the spring holds the closing body in an open position when the actuator is inactive and hydraulic pressure compensation is present.

3. The injection system of claim 1, wherein the actuator is configured to, upon activation and with hydraulic pressure compensation present, move the closing body to the closed position against the force of the spring.

4. The injection system of claim 1, wherein the outlet valve includes an actuator rod connected to the closing body and to an armature, and wherein the spring is supported between the armature and a housing section of the outlet valve.

5. The injection system of claim 4, wherein:

the outlet valve has a housing having a first end at which the valve seat is arranged and an opposite second end that provides a connection for the high-pressure region, and the actuator rod extends through the housing section provided with at least one through-flow opening.

6. The injection system of claim 1, wherein the closing body is spherical and cooperates with a conical valve seat.

7. The injection system of claim 1, wherein the injection system does not have a pressure relief valve for the high-pressure region.

8. An internal combustion engine, comprising:

a high-pressure pump with a compression chamber, the pump operable to deliver fuel under high pressure to a high-pressure region of the internal combustion engine that feeds a plurality of injectors, an inlet valve, and an electrically switched, digitally activated outlet valve comprising:

a valve seat, a closing body cooperating with the valve seat, an electromagnetically actuated actuator for the closing body, and a spring cooperating with the closing body, wherein the outlet valve is a normally-open outlet valve, and wherein fuel flows from the compression chamber to the high-pressure region if the actuator is inactive and a fuel pressure in the compression chamber is higher than a fuel pressure in the high-pressure region.

9. The internal combustion engine of claim 8, wherein the spring holds the closing body in an open position when the actuator is inactive and hydraulic pressure compensation is present.

10. The internal combustion engine of claim 8, wherein the actuator is configured to, upon activation and with hydraulic pressure compensation present, move the closing body to the closed position against the force of the spring.

11. The internal combustion engine of claim 8, wherein the outlet valve includes an actuator rod connected to the closing body and to an armature, and wherein the spring is supported between the armature and a housing section of the outlet valve.

12. The internal combustion engine of claim 11, wherein:

the outlet valve has a housing having a first end at which the valve seat is arranged and an opposite second end that provides a connection for the high-pressure region, and the actuator rod extends through the housing section provided with at least one through-flow opening.

13. The internal combustion engine of claim 8, wherein the closing body is spherical and cooperates with a conical valve seat.

14. The internal combustion engine of claim 8, wherein the injection system does not have a pressure relief valve for the high-pressure region.

* * * * *